US005459503A

United States Patent [19]

Ishii

[11] Patent Number: 5,459,503

[45] Date of Patent: Oct. 17, 1995

[54] XEROGRAPHIC SERIAL PRINTER WITH CARRIAGE BELOW THE PAPER PATH

[75] Inventor: Masato Ishii, Kawasaki, Japan

[73] Assignee: Fujitsu Limited, Kawasaki, Japan

[21] Appl. No.: 291,868

[22] Filed: Aug. 17, 1994

[30] Foreign Application Priority Data

Sep. 2, 1993 [JP] Japan ..... 5-218699

[51] Int. Cl.[6] ..... B41J 2/45; G03G 15/00

[52] U.S. Cl. ..... 347/152; 347/138; 355/210; 400/320

[58] Field of Search ..... 347/152, 156, 347/138, 130; 355/210, 211; 101/DIG. 37; 400/55, 320

[56] References Cited

U.S. PATENT DOCUMENTS 4,639,749 1/1987 Ito ..... 346/1

5,196,870 3/1993 Itoh et al. ..... 346/130

*Primary Examiner*—Joan H. Pendegrass

*Assistant Examiner*—Quana M. Grainger

*Attorney, Agent, or Firm*—Armstrong, Westerman, Hattori, McLeland and Naughton

[57] ABSTRACT

A xerographic serial printer includes a sheet feeding mechanism for feeding a recording sheet, a xerographic recording head for recording a toner image on a recording sheet, a carriage disposed below a sheet path for carrying the xerographic recording head such that the xerographic recording head records the image on a lower major surface of the recording sheet, a carriage actuation mechanism for driving the carriage along a recording sheet in a horizontal direction such that the xerographic recording head scans the lower major surface in the horizontal direction, a platen plate disposed above the recording sheet feed path in engagement with an upper major surface of the recording sheet, for causing a transfer of the toner image to the lower major surface of the recording sheet, and a fixing unit for fixing the toner image transferred to the lower major surface of the recording sheet by heating the toner image on the recording sheet.

8 Claims, 4 Drawing Sheets

XEROGRAPHIC SERIAL PRINTER WITH CARRIAGE BELOW THE PAPER PATH

BACKGROUND OF THE INVENTION

The present invention generally relates to xerographic printers and more particularly to a xerographic serial printer for recording an image on a recording sheet based upon a toner image formed on a recording drum in correspondence to an electrostatic latent image.

In recent years, there is a demand for low cost and compact xerographic printers. In order to meet such a demand, xerographic serial printers are developed. In a xerographic serial printer, a xerographic processing head is held on a carriage for recording images. Xerographic printers generally provide a higher quality image recording, while there is a persisting demand for higher recording quality and higher recording density.

FIGS. 1A and 1B show the essential part of a conventional xerographic serial printer including the carriage respectively in a plan view and in an oblique view.

Referring to FIGS. 1A and 1B, the printer includes a carriage 11 that in turn includes a carrier member 13 and a xerographic processing head 12 mounted upon the carrier member 13. Further, the carriage 11 has a guide part 14 in engagement with a guide shaft 15. Thus, the carriage 11 is moved by a motor not illustrated over a platen 16 in a direction perpendicular to a sheet feed direction.

At both sides of the carriage 11, there are provided feed rollers 17*a* and 17*b* for feeding a sheet 18, wherein the feed roller 17*b* in the downstream side of a sheet feed path incorporates therein a heat source for fixing the toner image transferred upon the recording sheet 18. It should be noted that the feed rollers 17*a* and 17*b* are provided such that the sheet 18 is transported horizontally between the carriage 11 and the platen 16.

The xerographic processing head 12 includes, as indicated in FIG. 1B, a recording drum 21 rolling in the moving direction of the carriage 11, a precharger 22 for charging the surface of the recording drum 21, an exposure unit 23 for forming an electrostatic latent image on the surface of the recording drum 21, a developing unit 25 for developing the electrostatic latent image on the recording drum 21 by means of toners 24 to form a toner image, and a cleaner 26 for removing the toners remaining on the recording drum 21 after the toner image is transferred to the recording sheet 18.

In operation, the xerographic printer records an image on the recording sheet 18 by the xerographic processing head 12 while moving the carriage 11 in the direction perpendicular to the sheet feeding direction. Further, the recording sheet 18 is transported in the sheet feeding direction by means of the feed rollers 17*a* and 17*b*. It should be noted that the xerographic processing head 12 is provided above the recording sheet 18, and the recording head 12 transfers the toner image on the recording drum 21, formed as a result of the development of the electrostatic latent image thereon by way of the development unit 25, by applying a predetermined voltage to the platen 16. As already noted, the electrostatic latent image is formed on the recording drum 21 by means of the precharge unit 22 and the exposure unit 23.

After one line of recording is completed on the recording sheet 18 by scanning the carriage 11, the feed rollers 17*a* and 17*b* feed the recording sheet by a predetermined amount. Further, the carriage 11 returns to a predetermined home position corresponding to the origin. The toner image thus transferred to the recording sheet 18 is then fixed thereon as a result of heating by the feed roller 17*b*.

By repeating the foregoing recording process for one line a plurality of times, a desired image is recorded on the recording sheet 18.

In the conventional printer of FIGS. 1A and 4B, it should be noted the carriage 11 is located above the recording sheet 18 and achieves the recording on an upper major surface of the recording sheet 18 while being moved laterally, with respect to the sheet feeding direction, at a high speed. Thus, there is a tendency that the toners 24 held in the head 12 spreads on the recording sheet to form spots. Further, there is a tendency that the density of recording becomes non-uniform along the path of the carriage 11. In addition there occurs a problem, when the carriage 11 stops on the recording sheet 18, in that the toners 24 fall on the recording sheet 18 to form spots.

SUMMARY OF THE INVENTION

Accordingly, it is a general object of the present invention to provide a novel and useful xerographic serial printer wherein the foregoing problems are eliminated.

Another and more specific object of the present invention is to provide a xerographic serial printer that records an image on a sheet without substantial recording defects such as toner spots or non-uniform toner density.

Another object of the present invention is to provide a xerographic serial printer, comprising:

sheet feeding means for feeding a recording sheet in a sheet feed direction along a sheet feed path;

xerographic recording head means for recording an image on said recording sheet, said recording head means including: an image carrier roller rotatable about a rotational axis for carrying a toner image, said xerographic recording head means being disposed such that said rotational axis of said image carrier roller extends parallel to said sheet feed direction; exposure means for exposing an image on a circumferential surface of said image carrier roller to form an electrostatic latent image; and developing means for developing said exposed image by applying toners to convert said electrostatic latent image to a toner image;

a carriage disposed below said sheet path for carrying said xerographic recording head means, such that said xerographic recording head means records said toner image on said image carrier on a lower major surface of said recording sheet fed along said sheet feed path;

carriage actuation means for driving said carriage along a recording sheet on said sheet feed path, in a horizontal direction which is set perpendicular to said sheet feed direction, such that said xerographic recording head means scans said lower major surface in said horizontal direction;

image transfer means disposed above said recording sheet feed path in engagement with an upper major surface of said recording sheet, for causing a transfer of said toner image on said image carrier to said lower major surface of said recording sheet; and fixing means for fixing said toner image transferred to said lower major surface of said recording sheet by heating said toner image on said recording sheet.

According to the present invention, the carriage is disposed below the recording sheet fed along the sheet feed path. Associated therewith, the xerographic recording head means has an opening for exposing the image carrier at a top side thereof. As a result, the risk that toners spread on the recording sheet during the movement of the carriage or during the stationary state of the carriage is successfully eliminated. As a result, a high quality, stable recording, free from defects, is guaranteed.

DETAILED DESCRIPTION OF THE PREFERRED EMBODIMENTS

Figure 1A:
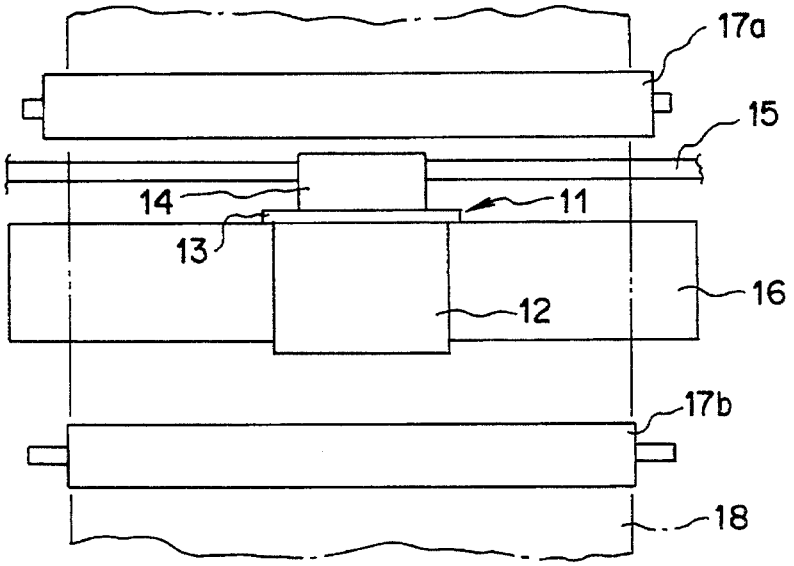
FIG. 1A PRIOR ART
FIGS. 1A and 1B are diagram showing the construction of a conventional xerographic serial printer.
Figure 1B:
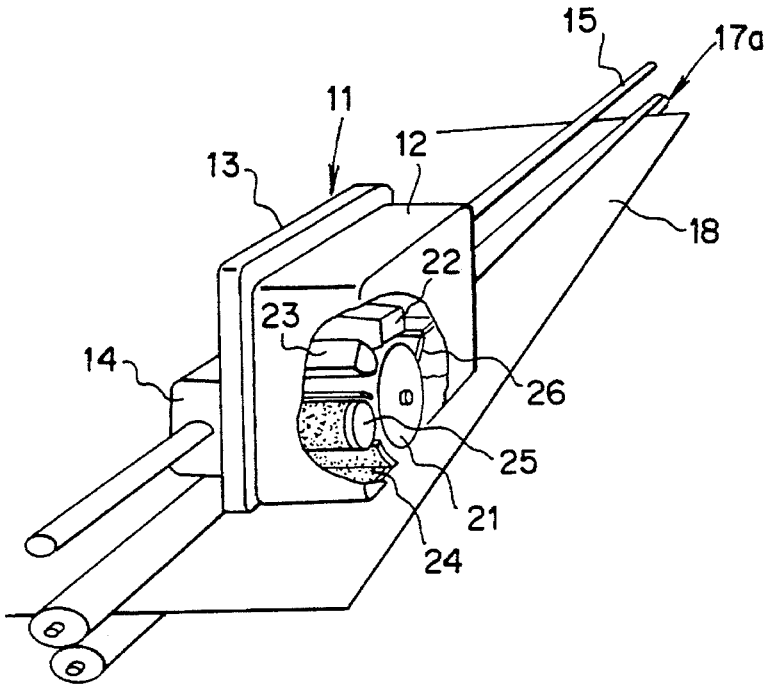
FIG. 1B PRIOR ART
Figure 2:
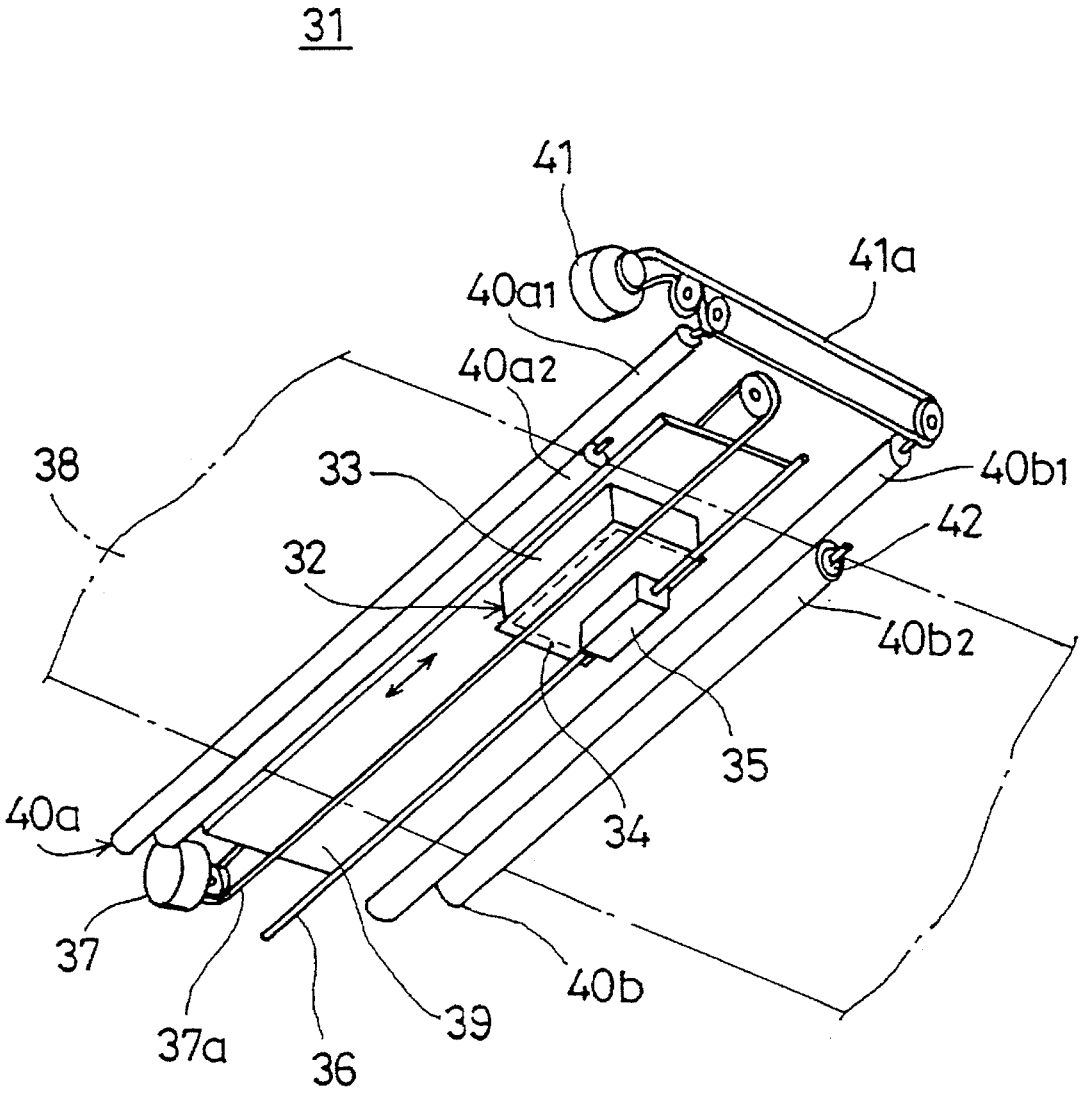
FIG. 2 is a diagram showing the construction of a xerographic serial printer according to a first embodiment of the present invention.

FIG. 2 shows a xerographic serial printer 31 according to a first embodiment of the present invention, wherein FIG. 2 represents the part of the printer 31 including a carriage 32 in an enlarged scale.

Referring to FIG. 2, the carriage 32 of the xerographic serial printer 31 includes a carrier member 34 on which a xerographic processing unit 33 is mounted for recording images, wherein the xerographic processing unit 33 has an opening for recording the images such that the opening faces in an upward direction.

The carrier member 34 carries a guide member 35 at the lower surface thereof. The guide member 35 engages mechanically to a guide shaft 36, and the carrier member 34 is moved along the guide shaft 36 as a result of energization of a drive motor 37. It should be noted that the drive motor 37 drives the carrier member 34 and hence the carriage 32 itself by way of a drive belt 37*a* in a direction perpendicularly to a sheet feed direction for feeding a recording sheet 38, as indicated by an arrow in FIG. 2. In FIG. 2, it should be noted that the recording sheet 38 is fed along a predetermined sheet feed path over the carriage 32 in the sheet feed direction.

Above the carriage 32 there is provided a platen 39 such that the platen 39 is located above the sheet feed path for engagement with an upper major surface of the recording sheet 38 passing over the carriage 32 along the sheet feed path. Typically, the platen 39 is formed of a plate of aluminum or aluminum alloy, and causes a transfer of images from the xerographic processing unit 33 to a lower major surface of the recording sheet 38.

At both sides of the platen 39, there are provided two pairs of sheet feed rollers 40*a* and 40*b* for feeding the recording sheet 38 in the sheet feed direction. The roller pair 40*a* is provided at the upstream side of the sheet feed path and includes rollers $40a_1$ and $40a_2$ each having a rotational axis parallel to the elongating direction of the platen 39, for feeding the recording sheet 38 by respectively engaging with the upper and lower major surfaces of the recording sheet 38. The roller pair 40*b*, on the other hand, is provided at the downstream side of the sheet feed path and includes rollers $40b_1$ and $40b_2$ each having a rotational axis parallel to the elongating direction of the platen 39, for feeding the recording sheet 38 by respectively engaging with the upper and lower major surfaces of the recording sheet 38. Further, the feed roller $40b_2$ at the downstream side is provided with a heating element 42 that may be a halogen lamp for fixing the toner images transferred by the xerographic processing unit 33 on the carriage 32, upon the lower major surface of the recording sheet 38.

Figure 3A:
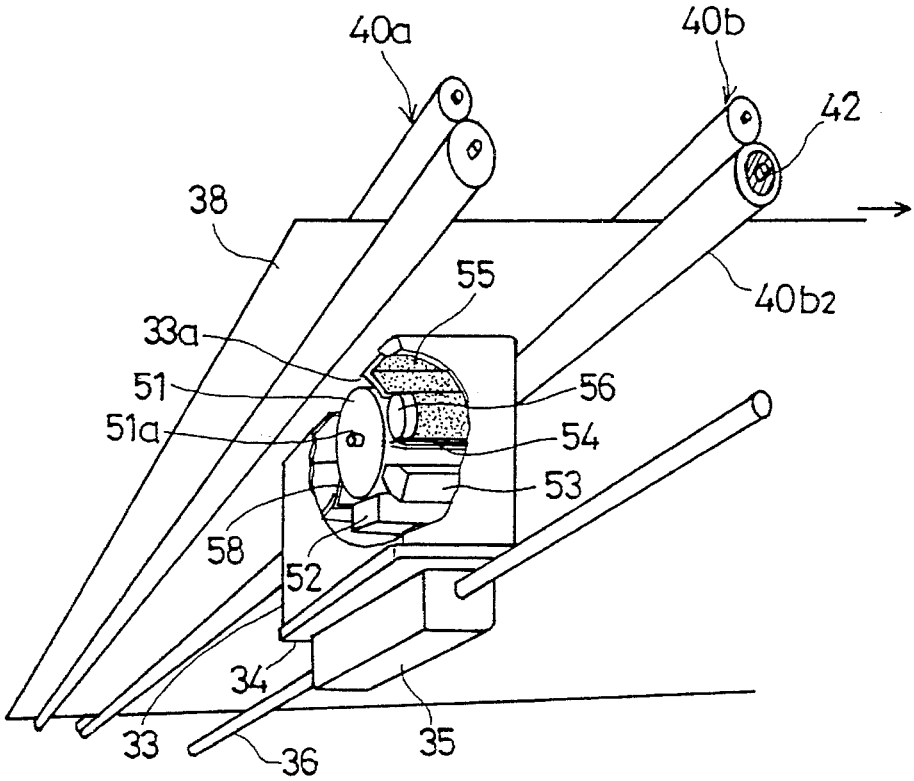
FIGS. 3A and 3B are diagrams showing the essential part of the xerographic serial printer of FIG. 2.
Figure 3B:
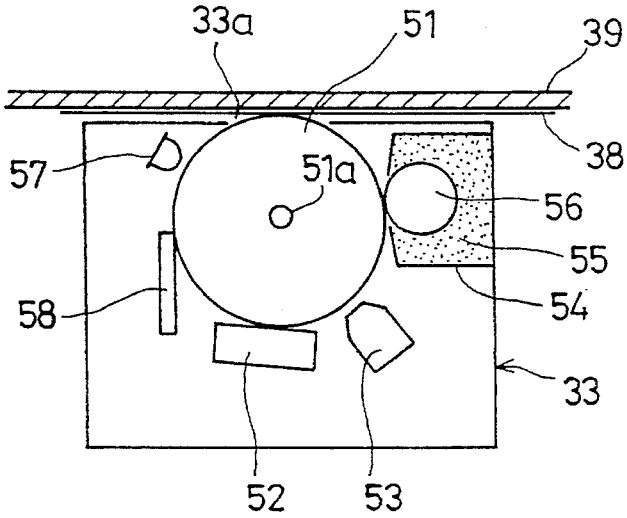

FIGS. 3A and 3B show the construction of the carriage 33 of FIG. 2, wherein FIG. 3A shows the interior of the carriage 33 in a perspective view while FIG. 3B shows an elevational cross section.

Referring to FIGS. 3A and 3B, the xerographic processing unit 33 has an opening 33*a* at an upper part thereof for exposing a photosensitive recording drum 51 that carries a toner image on a circumferential surface. The recording drum 51 is provided to roll in the moving direction of the carriage 32 about a rotational axis 51*a*, wherein the rotational axis 51*a* extends parallel to the sheet feed direction. Thus, the recording drum 51 engages with the lower major surface of the recording sheet 38 on the sheet feed path, with a speed corresponding to the moving speed of the carriage 32.

The processing unit 33 further includes a precharger 52 that charges the surface of the recording drum 51 uniformly. Further, the processing unit 33 includes an exposure unit 53, wherein the exposure unit records an image on the circumferential surface of the recording drum 51 in the form of electrostatic latent image, wherein the electrostatic latent image thus formed is developed by applying toners 55 held in a development unit 54 by means of a development roller 56 forming a part of the development unit 54. It should be noted that the development unit 54 is provided also within the processing unit 33.

As a result of the development, the electrostatic latent image on the recording drum 51 is converted to a toner image. The toner image thus formed on the drum 51 is transferred to the lower major surface of the recording sheet 38 on the sheet feed path, by engaging the drum 51 to the recording sheet 38 and by applying a predetermined voltage between the drum 51 and the platen 39.

Further, the processing unit 33 includes a discharge unit for discharging the recording drum 51 after the transfer of the toner image is made, and the toner remaining on the circumferential surface of the recording drum 51 is scraped off by a cleaner 58.

In operation, the recording sheet 38 is fed along the sheet feed path by way of the feed rollers 40*a* and 40*b* over the carriage 32. Next, the recording sheet 38 is held stationary, and the carriage 32 is caused to scan the lower major surface of the recording sheet 38 thus held over the carriage 32 in the horizontal direction that is perpendicular to the sheet feed direction. As a result of the scanning of the carriage 32, the recording drum 51 in the xerographic processing unit 33 rolls in the horizontal direction while maintaining a contact engagement with the recording sheet 38 urged against the recording drum 51 by the platen 39.

After each line of recording, the carriage 32 returns to a predetermined home position, and the feed rollers 40*a* and 40*b* feeds the recording sheet 38 in the sheet feed direction, with a predetermined amount. Typically, the recording sheet 38 is fed with an amount corresponding to the width of the recording drum 51 measured in the direction of the rotational axis 51*a*. Upon feeding of the recording sheet 38, the toner image transferred to the lower major surface of the recording sheet 38 passes through the feed roller $40b_2$ and fixed upon the sheet 38 as a result of heating by the heating element 42 provided on the feed roller 40$b_2$. Typically, the heating element 42 heats the sheet 38 to a temperature of about 180° C.

In the xerographic serial printer of the present invention wherein the carriage 32 is provided below the recording sheet 38 and the xerographic processing unit 33 records an image on the lower major surface of the recording sheet 38, it should be noted that the problem of formation of toner spots on the recording sheet 38 does not occur, even when the toners 55 are scattered out from the opening 38*a* upon the quick reciprocal movement of the carriage 32. In other words, the xerographic printer of the present invention is substantially immune to the defect of recording such as spots, and one can obtain a stable, high quality recording of images. It should also be noted that the contamination of the recording sheet does not occur even when the carriage has stopped at the position other than the home position.

Figure 4A:
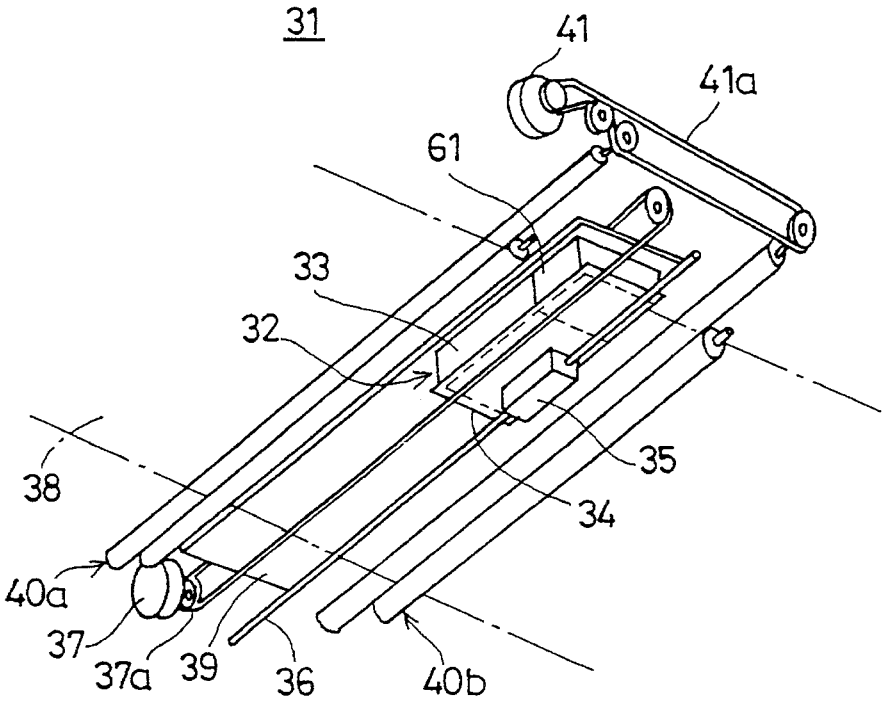
FIGS. 4A and 4B are diagrams showing the essential part of a xerographic serial printer according to a second embodiment of the present invention.
Figure 4B:
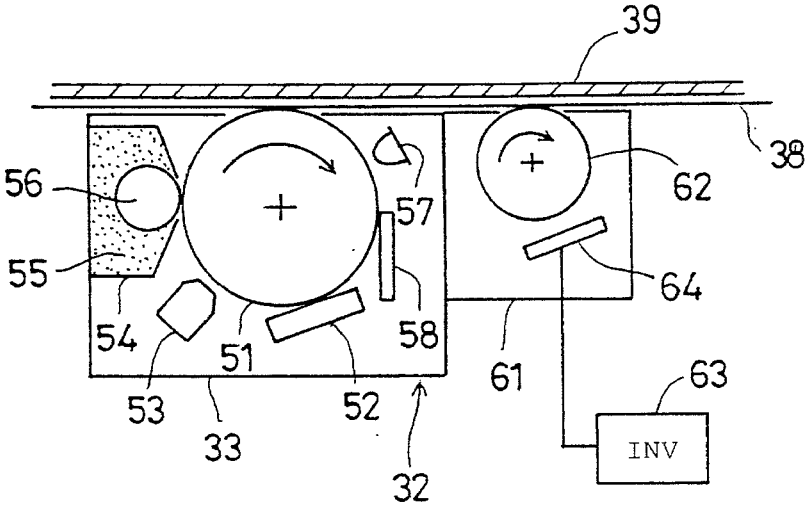

FIGS. 4A and 4B show a second embodiment of the present invention, wherein FIG. 4A shows the essential part of the xerographic serial printer of the present embodiment in an oblique view while FIG. 4B shows the xerographic processing unit used in the printer of the present embodiment in an elevational cross section.

Referring to FIG. 4A, it will be note that the xerographic serial printer 31 includes a fixing unit 61 inside the carriage 32 for engagement with the recording sheet 38, such that the fixing unit 61 moves together with the xerographic processing unit 33 along the guide shaft 36 behind the recording drum 51. In this embodiment, the platen 39 may be formed of an aluminum plate covered by a heat resistant conductive material such as a silicon rubber admixed with electric conductor.

The fixing unit 61 includes a fixing roller 62 of a magnetic cylinder covered by a fluoroplastic coating as indicated in FIG. 4B, wherein the fixing roller 62 is held at a predetermined temperature by way of a regulation unit 64 controlled by an inverter circuit 63. The fixing unit 61 is moved with the processing unit 33 and achieves the fixing of the toner image upon the recording sheet 38 immediately after the transfer of the toner image upon the recording sheet 38.

Further, the present invention is not limited to the embodiments described heretofore, but various variations and modifications may be made without departing from the scope of the invention.

What is claimed is:

1. A xerographic serial printer, comprising:

sheet feeding means for feeding a recording sheet in a sheet feed direction along a sheet feed path;

xerographic recording head means for recording an image on said recording sheet, said recording head means including: an image carrier roller rotatable about a rotational axis for carrying a toner image, said xerographic recording head means being disposed such that said rotational axis of said image carrier roller extends parallel to said sheet feed direction; exposure means for exposing an image on a circumferential surface of said image carrier roller to form an electrostatic latent image; and developing means for developing said exposed image by applying toners to convert said electrostatic latent image to a toner image;

a carriage disposed below said sheet path for carrying said xerographic recording head means, such that said xerographic recording head means records said toner image on said image carrier on a lower major surface of said recording sheet fed along said sheet feed path;

carriage actuation means for driving said carriage along a recording sheet on said sheet feed path, in a horizontal direction which is set perpendicular to said sheet feed direction, such that said xerographic recording head means scans said lower major surface in said horizontal direction;

image transfer means disposed above said recording sheet feed path in engagement with an upper major surface of said recording sheet, for causing a transfer of said toner image on said image carrier to said lower major surface of said recording sheet; and fixing means for fixing said toner image transferred to said lower major surface of said recording sheet by heating said toner image on said recording sheet.

2. A xerographic serial printer as claimed in claim 1, wherein said image transfer means comprises a platen of a conductive plate member for engagement with said upper major surface of said recording sheet, said platen holding said recording sheet on said sheet feed path such that said image carrier roller engages with said lower major surface of said recording sheet.

3. A xerographic serial printer as claimed in claim 1, wherein said sheet feeding means comprises a plurality of feed roller pairs, one of said feed roller pairs being disposed at the upstream side of said sheet feed path, the other of said feed roller pairs being disposed at the downstream side of said sheet feed path, each of said feed roller pairs including upper and lower rollers respectively for engagement with said upper and lower major surfaces of said recording sheet.

4. A xerographic serial printer as claimed in claim 3, wherein said fixing means comprises a heat source provided in said feed roller pairs located at the downstream side of said sheet feed path with respect to said image transfer means.

5. A xerographic serial printer as claimed in claim 1, wherein said carriage carrying thereon said fixing means behind said xerographic recording head means such that said fixing means scans said lower major surface of said recording sheet in said horizontal direction after said xerographic recording head means.

6. A xerographic serial printer as claimed in claim 1, wherein said carriage actuation means includes a guide shaft extending in said horizontal direction for guiding said carriage.

7. A xerographic serial printer as claimed in claim 1, wherein said xerographic recording head means includes a case for accommodating said image carrier roller, said exposure means and said developing means, said case having an opening at a top part thereof for exposing said image carrier roller.

8. A serial printer, comprising:

sheet feeding means for feeding a recording sheet in a sheet feed direction along a sheet feed path;

recording head means for recording an image on said recording sheet;

a carriage disposed below said sheet path for carrying said recording head means, such that said recording head means records an image on a lower major surface of said recording sheet fed along said sheet feed path; and carriage actuation means for driving said carriage along a recording sheet on said sheet feed path, in a horizontal direction which is set perpendicular to said sheet feed direction, such that said recording head means scans said lower major surface in said horizontal direction.

* * * * *